US006659048B1

(12) United States Patent
DeSantis et al.

(10) Patent No.: US 6,659,048 B1
(45) Date of Patent: Dec. 9, 2003

(54) SUPERCHARGED HOT WATER HEATER

(75) Inventors: Paul Mark DeSantis, Racine, WI (US); Terrence William Snyder, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/414,395

(22) Filed: Apr. 15, 2003

Related U.S. Application Data

(60) Provisional application No. 60/387,010, filed on Jun. 6, 2002.

(51) Int. Cl.[7] ..... F24H 1/20

(52) U.S. Cl. ..... 122/20 R; 122/13.3; 392/444

(58) Field of Search ..... 122/20 R, 13.01, 122/13.3, 20 B; 392/444, 447, 448, 455

(56) References Cited

U.S. PATENT DOCUMENTS

| | | | | | |
|---|---|---|---|---|---|
| 3,351,239 | A | * | 11/1967 | Flock | 222/54 |
| 4,424,767 | A | * | 1/1984 | Wicke et al. | 122/13.3 |
| 4,517,445 | A | * | 5/1985 | Tatsumi et al. | 392/444 |
| 4,680,446 | A | * | 7/1987 | Post | 392/451 |
| 5,836,236 | A | | 11/1998 | Rolfes et al. | 99/290 |
| 5,875,703 | A | | 3/1999 | Rolfes | 99/283 |
| 5,953,981 | A | | 9/1999 | Lassota | 99/281 |
| 6,227,101 | B1 | | 5/2001 | Rabadi et al. | 99/280 |
| 6,283,067 | B1 | * | 9/2001 | Akkala | 122/14.22 |
| 6,363,216 | B1 | | 3/2002 | Bradenbaugh | 392/463 |
| 6,588,377 | B1 | * | 7/2003 | Leary et al. | 122/19.1 |

OTHER PUBLICATIONS

Photograph of Kitchen–Aide Model # HD1000XSC by Whirlpool.
Photograph of Elkay Hot Water Machine Model #LKH–180.
Photograph of Quooker Pro 3 by Peteri.
Photograph of Tea Tap by Zip Heaters.
Photograph of Boiling Point Model #BP100C by Hotta.
Photograph of Redring Model# 45–793207.
Photograph of Chronomite Model E–46RLP.

* cited by examiner

*Primary Examiner*—Gregory Wilson
(74) *Attorney, Agent, or Firm*—Howrey Simon Arnold & White LLP

(57) ABSTRACT

Embodiments of the present invention provide a hot water dispenser capable of heating water to near boiling temperatures (e.g., 205° F. to 212° F.). When water at near boiling temperatures is required, a secondary heating element is activated. The secondary heating element is in thermally coupled to the dispensing tube so that the water in the tube may be further heated as it passes through the dispensing tube from the tank to the dispensing outlet. Heating the water to near boiling just prior to its being dispensed reduces energy costs because the near boiling temperature water is not stored and allowed to cool. Additionally, the need for expensive insulation or expensive thermostats is eliminated.

25 Claims, 5 Drawing Sheets

SUPERCHARGED HOT WATER HEATER

PRIORITY CLAIM

This application claims the benefit of U.S. Provisional Patent Application Ser. No. 60/387,010 filed on Jun. 6, 2002, which is hereby incorporated by reference in its entirety.

FIELD OF THE INVENTION

The present invention relates generally to hot water heaters and more particularly to near boiling hot water heaters.

BACKGROUND OF THE INVENTION

Hot water dispensers that mount to sinks are common. Such dispensers consist of two main parts, a water tank with a heater and a faucet. In the water tank water is heated by the heater and stored until needed. The tank and associated plumbing are usually installed below the sink where they are out of the view of the user. The faucet is usually mounted above the sink such that a user can dispense the amount of hot water desired while any excess hot water falls harmlessly into the sink. Such dispensers are typically used by opening a valve on the faucet to dispense the hot water stored in the tank to the user who can then enjoy, for example, a hot cup of soup, hot chocolate, or tea. Several different methods may be used to open the valve such as twisting a handle, depressing a lever, or pushing a button on the faucet.

A typical prior art hot water dispenser, such as the In-Sink-Erator, Instant Hot™, hot water dispenser, model number H-990-W-5, is shown in FIG. 1. Such prior art hot water dispensers 10 are typically mounted such that the water tank 12, with the heater 18, is attached to a wall beneath the sink by well known means. The faucet 34, with the activating valve 32, is typically attached to the upper surface of the sink through a hole in the sink cabinet's upper surface and is oriented such that any water emanating from the faucet will fall into the sink and drain away. Tubing 20, 26, 28, and 30, typically copper, stainless steel, or plastic, connects the faucet 34 with the tank 12. Tubing 28 allows hot water 16 in the tank 12 to flow to faucet 34. Tube 30 is connected to a water supply by any suitable means known in the plumbing arts. Prior art hot water dispensers typically heat the dispensed water 16 to a temperature below boiling, typically between 180° F. and 190° F.

Tank 12 is made of any suitable material such as stainless steel, copper, or high temperature plastic that can hold the heated water 16 in the tank. The water 16 in the tank 12 is heated by heating element 18. Heating element 18, in the prior art, is typically a 750-watt electric heating element that is regulated by a temperature adjustable thermostat 14 (electrical connection not shown).

A fixed baffle 22 divides the tank 12 into a hot water storage area 40 and an expansion area 24. Tube 26 acts as a vent for expansion area 24 so that neither low pressure nor high pressure will be created to restrict the flow of water into and out of expansion area 24. The baffle 22 is a rigid or semi-rigid material, such as stainless steel, copper or heat resistant plastic to which venturi 38 may be attached. The expansion area allows for any water remaining in tube 28 after water flow into the tank is shut off through tube 20 to drain into the expansion area through hole 42. Additionally, because the cool water that has replaced the water used expands by about 8 percent as it is heated, an expansion area must be provided or water will be forced out of tube 28 where it would drip from faucet 34. Consequently the heated and expanded water flows into venturi 38 through hole 42 and into expansion area 24. The venturi 38 is affixed about the lower end of tube 28. As water is forced out of tube 28 venturi 38 creates low pressure at opening 42 as water in tube 28 flows past it. The low pressure draws water from expansion area 24 through the opening thus draining any accumulated water in expansion area 24.

In order to dispense hot water 16, the user activates a spring-loaded, twist-actuated valve 32, although any type of on-off water valve may be used, to allow cold water in tube 30 to flow into tube 20. Tube 20 is connected to the bottom of tank 16 at inlet 36. As relatively cold water enters the tank 12 through inlet 36, hot water is forced out of tank 12 and into dispensing tube 28 and ultimately through faucet 34. Faucet 34, In-Sink-Erator™ model number 41760, amongst other things, constitutes a mounting device for valve 32 and a conduit for various tubes carrying water to and from the tank 12. After an amount of hot water is dispensed in this fashion, the cold water received at inlet 36 is heated in preparation for the next activation of valve 32.

In some applications it is desirable to dispense water hotter than 190° F. For example some users can taste the difference between tea that is brewed using water at 190° F. versus water that is near boiling (e.g., 205° F.–212° F.), and these users prefer the latter temperature. Water at near boiling temperatures may be desirable for other reasons as well.

Because of the desire for water at near boiling temperatures, other types of prior art hot water dispensers have been designed that heat the dispensed water to near boiling, and some even flash the water to steam before dispensing the water or steam. These prior art hot water dispensers provide hot water at or above 205° F. or may even provide steam for such uses as cappuccino. These types of prior art hot water dispensers provide near boiling hot water by utilizing highly accurate (and consequently expensive) thermostats to continuously cycle the heating element on and off in order to maintain the requisite near boiling water temperature.

These types of near boiling dispenser must contend with the possibility that the heated water may boil and turn into steam, thereby greatly expanding in volume and providing the potential for damaging components and injuring users. While steam generation is desired in some circumstances, the hot water dispenser must be designed to prevent the damaging effects of steam generation. In order to prevent damage from steam generation, typical prior art hot water dispensers typically utilize a pressure relief valve on the tank to prevent overpressure in the tank.

The reader is referred to the following references for further background regarding the design and operation of prior art hot water heaters, which are incorporated herein by reference in their entirety: U.S. Pat. Nos. 6,266,485, 6,256,465, 6,094,524, 6,069,998, 4,513,887, and pending application Ser. No. 09/564,199 filed May 4, 2000.

It has generally been regarded as difficult to design a relatively cheap, reliable, and safe system that can dispense near boiling water. Prior art hot water dispensers that dispense near boiling hot water are expensive to manufacture and operate. In this regard, it should be noted that the heat loss rate of water increases as its temperature increases. In other words, 205° F. water cools quicker than water between say 180° F. to 190° F. Thus the higher temperature water must be reheated more often than cooler water to keep it at the desired temperature, which raises energy costs. To compensate for the increased heat loss rate of higher temperature water, additional insulation can be used around the tank. Of course more insulation leads to higher manufacturing costs. Additionally, because the water is being held at a temperature closer to its boiling point, a more accurate thermometer must be used to avoid overheating the water. Overheating the water could lead to unwanted steam generation and higher tank pressure than the tank is designed to withstand. A more accurate thermometer is expensive, which again leads to higher costs. Additionally, pressure relief or safety valves to protect against the possibility of damage due to steam generation further raise manufacturing costs.

SUMMARY OF THE INVENTION

Embodiments of the present invention provide a hot water dispenser capable of heating water to near boiling temperatures (e.g., 205° F. to 212° F.). When water at near boiling temperatures is required, a secondary heating element is activated. The secondary heating element is thermally coupled to the dispensing tube so that the water in the tube may be further heated as it passes through the dispensing tube from the tank to the dispensing outlet. Heating the water to near boiling just prior to its being dispensed reduces energy costs because the near boiling temperature water is not stored and allowed to cool. Additionally, the need for expensive insulation or expensive thermostats is reduced.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

In the disclosure that follows, in the interest of clarity, not all features and details of actual implementations of a hot water heater are necessarily described. It will of course be appreciated that in the development of any such actual implementation, as in any such project, numerous engineering and design decisions must be made to achieve the developer's specific goals and subgoals (e.g., compliance with mechanical and business-related constraints), which will vary from one implementation to another. Moreover, attention must necessarily be paid to proper engineering and design practices for the environment in question. However, while such a development effort for a hot water heater might be complex and time-consuming, it would nevertheless be a routine undertaking for those of skill in the art having the benefit of this disclosure.

Figure 1:
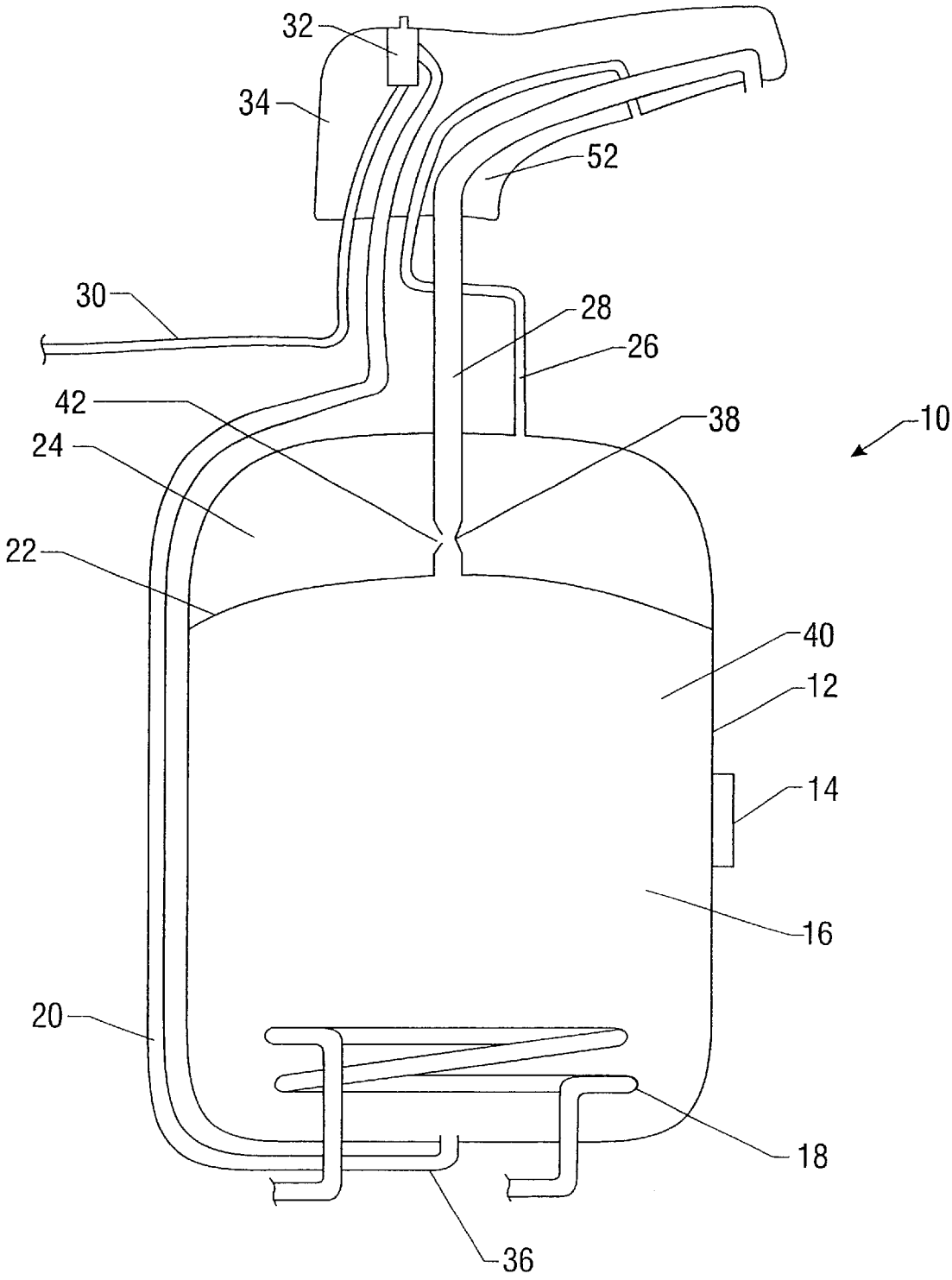
FIG. 1 (Prior Art)
FIG. 1 is a cross-sectional view of a conventional hot water dispenser.
Figure 2:
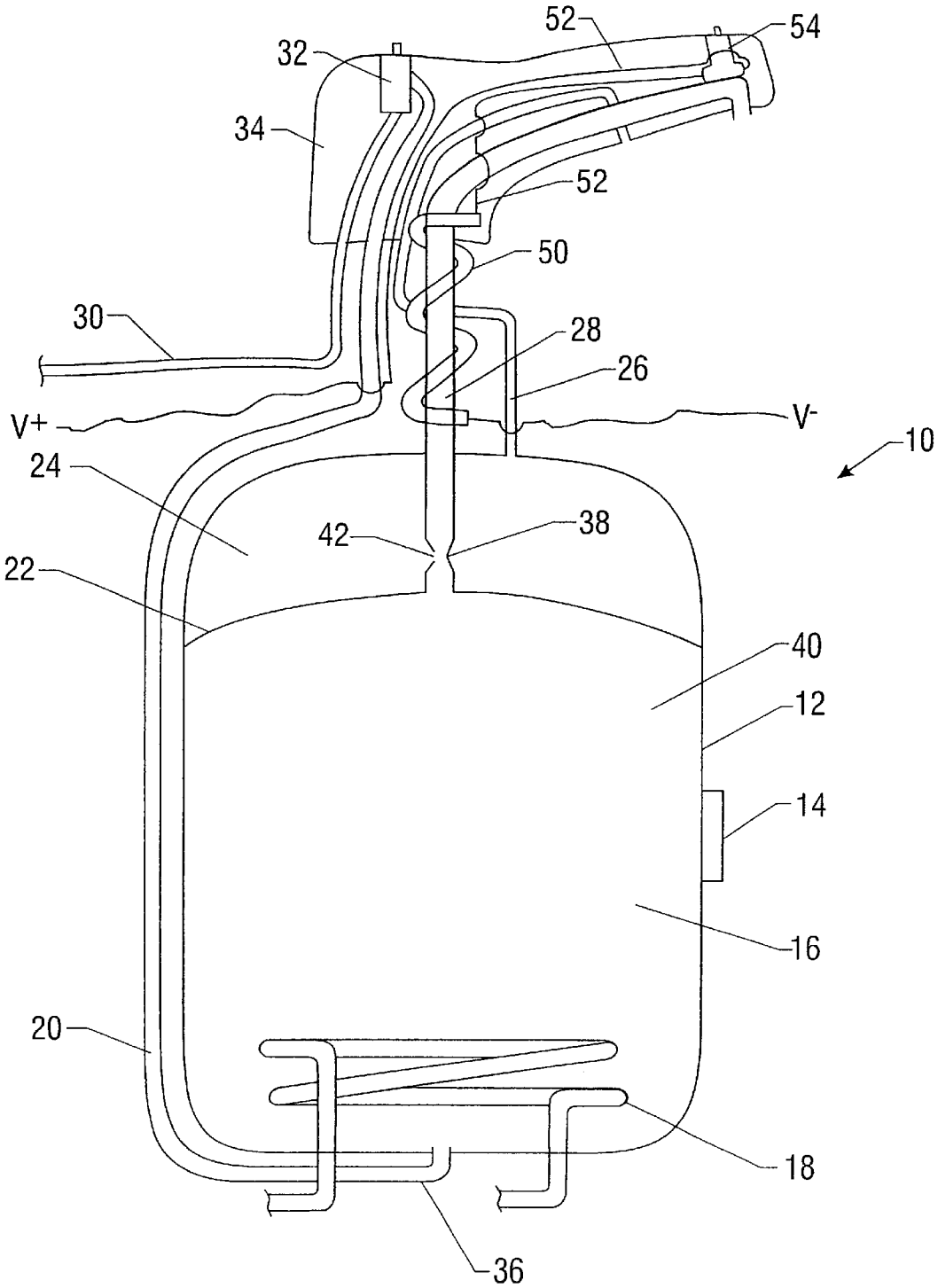
FIG. 2 is a cross-sectional view of a hot water dispenser with a secondary heating element.

FIG. 2 is a cross-sectional view of the type of hot water dispenser shown in FIG. 1, but which incorporates a secondary heating element 50 in accordance with one embodiment of the disclosed invention.

Secondary heating element 50 is envisioned as providing a high heat output in a small volume and is preferably rated for 1000 watts at 115 volts. However, any type of heating element, whether gas or electric, will work as long as enough heat is generated to provide the desired water temperature at the desired water flow rate.

Secondary heating element 50 is depicted wrapping about tube 28. Tube 28 is preferably stainless steel but may be copper, or any other suitable material that can affect heat transfer between secondary heating element 50 and tube 28. During testing, secondary heating element 50 was thermally coupled, by soldering, alongside and in parallel orientation, to tube 28. (Further details concerning a suitable secondary heating element are disclosed below). However, it is believed to be preferable to wind tube 28 about the exterior of heating element 50 (as shown) resulting in a mechanical compression fit between tube 28 and secondary heating element 50 and which facilitates increased heat transfer. However, any method of thermally coupling tube 28 and secondary heating element 50 about the exterior or interior of tube 28, such that the heat generated by secondary heating element 50 may be transferred to the water inside of tube 28, may be used. Secondary heating element 50 is preferably located as near as is reasonable to the dispensing outlet of faucet 34 to minimize cooling and to prevent steam from forcing near boiling water out of the faucet at high speed.

As in the prior art, water in tank 12 is preferably held at approximately 180° F.–190° F. As water is removed from tank 12 through tube 28, secondary heating element 50 raises the temperature of the water in tube 28, via heat transfer through tube 28, to near boiling temperature (e.g., 205° F.–212° F.) precluding the need to maintain water in tank 12 at near boiling temperatures. In addition to this safety and energy efficiency advantage, the present embodiment allows water to be dispensed at either hot (180° F.–190° F.) or near boiling (205° F.–212° F.) temperatures at the user's discretion. The tank 12 is preferably not pressurized but vented as described herein, although it could be pressurized with well-known modifications, as one skilled in the art will recognize.

The heat transfer rate should be matched to the desired flow characteristics of the hot water dispenser heater so that the appropriate dispensing temperature can be achieved. Preferably, a suitable heating element will provide an approximately 20° F. boost in water temperature at a water flow rate of approximately 0.5 gallons per minute, which would boost the water temperature from, say 180° F.–190° F. in the tank to 205° F.–210° F. Assuming perfect heat transfer between the secondary heating element and tube 28, it would be necessary to provide 68.67 watts of energy to the water to raise the temperature of 1 fluid ounce of water 1° F. each second.

Secondary heating element 50 is attached to a switch 54, such as a THERMO DISC™ model 36T, by wires 52. Wires 52 are in turn attached to a 115V A/C power source. Switch 54 is preferably a temperature-sensing switch. The thermal sensing portion of switch 54 is thermally coupled to tube 28 as shown and is held in place by mechanical means, such as welding, soldering, bolts, or a compression fit inside of the faucet 34, allowing switch 54 to sense the temperature of tube 28.

Switch 54 preferably goes to an off condition when tube 28 reaches a predetermined temperature, preferably 250° F., although any temperature in excess of the boiling point of water could be used. A cutoff temperature of 250° F. allows for tube 28 to be overheated but not excessively so. Slightly overheating tube 28 is allowable immediately prior to initiating water flow through tube 28 and again just after water flow through tube 28 ceases. Slightly overheating tube 28 is allowed to give some leeway for preheating tube 28, user error, etc., but the temperature must also be low enough that components are not damaged or users injured. Once switch 54 goes to an off condition, the user may reset the switch to activate secondary heating element 50 once temperatures have been allowed to cool below the trip temperature of switch 54. However, alternatively any switch that will activate secondary heating element 50 could be used, and such a switch need not be a temperature sensing switch.

By heating the water as it is dispensed, the need for an expensive, accurate thermostat is eliminated. An expensive thermostat is not needed because water is no longer held in the tank at near boiling temperatures, which requires careful monitoring to prevent steam generation. As noted earlier, steam generation would damage components and possibly injure a user. When water is held at temperatures that are not so close to boiling, such as in the current embodiment of this invention, safety is improved. Therefore, a slightly less accurate and consequently less expensive conventional thermostat 14 may be used to monitor the water temperature in the tank.

Figure 3:
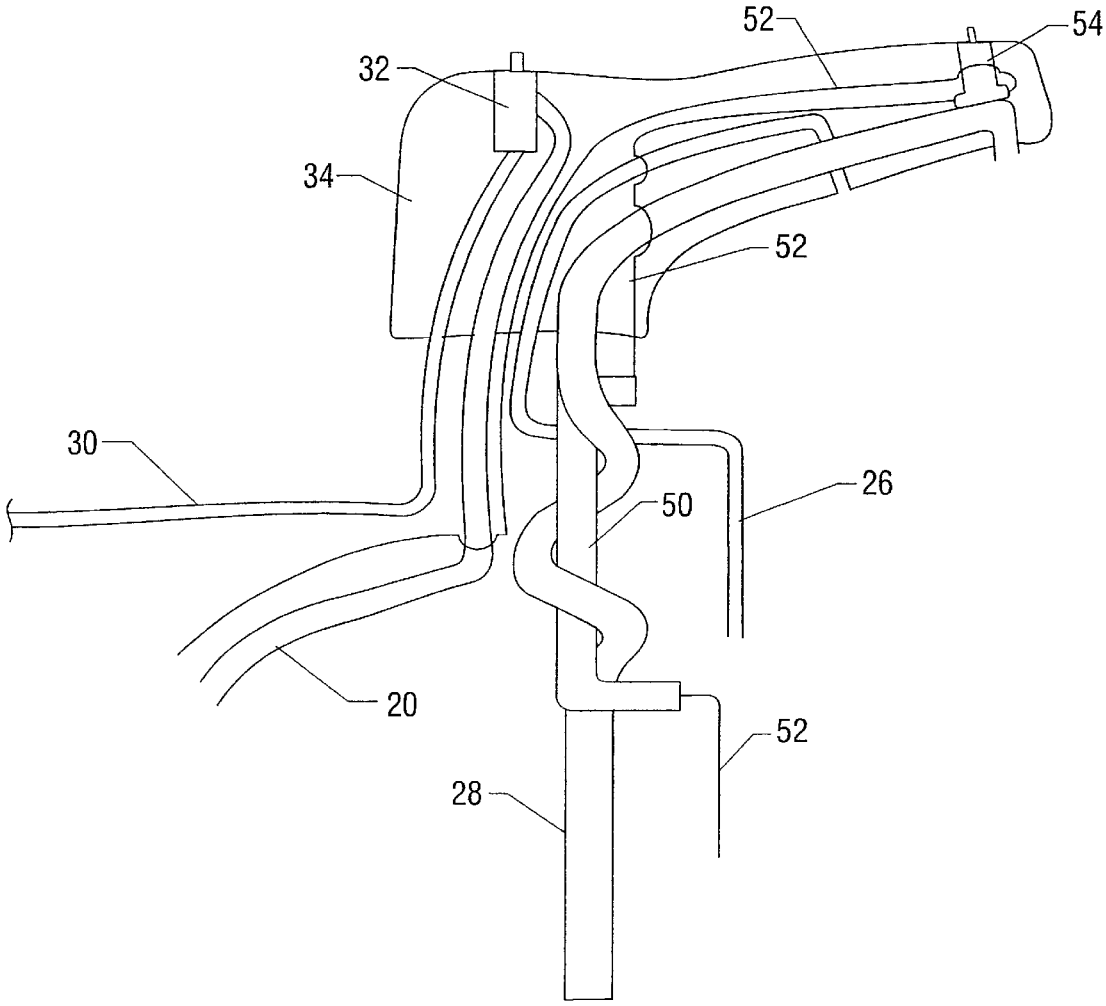
FIG. 3 is a cross-sectional view of the secondary heating element.

FIG. 3 is a cross-sectional view of the hot water dispenser secondary heating element and faucet 34 assembly. When more "normal" hot water (180° F.–190° F.) is desired by the user, the user simply activates valve 32 as in the prior art. However, when near boiling water is desired, switch 54 is activated. Switch 54 activates secondary heating element 50 as previously described. After switch 54 is activated a few seconds may be required to allow secondary heating element 50 to heat itself and tube ,28 before any appreciable amount of heat can be transferred to the water 16 in tube 28. In a preferred embodiment, valve 32 is then manually activated, by the user, causing water 16 to flow into tank 12 (not pictured) and forcing preheated water 16 through tube 28 where the water's temperature is boosted as previously described. If valve 32 is activated prior to or simultaneously with switch 54 then "normal" hot water will be dispensed during those few seconds required by secondary heating element 50 to heat up. Once valve 32 is manually deactivated, the flow of water through tube 28 ceases causing the temperature of tube 28 to rise. Switch 54 senses the rise in temperature of tube 28, causing secondary heating element 50 to be deactivated as discussed earlier.

In a modified embodiment, switch 54 can be connected to a timing circuit (not shown) which can electrically activate valve 32 without further intervention by the user. In such an embodiment, activation of switch 54 sends a signal to the timer circuit, which, after the execution of a delay (e.g. 2 seconds) sufficient for preheating the water: inside of tube 28, sends a signal to open valve 32. This embodiment conveniently allows the user to press or activate a single switch when near boiling point water is desired, and indeed might obviate the need for a user-activated valve 32. Such timer circuits, and methods of powering and connecting the same are well known and thus are not illustrated in further detail herein.

Figure 4:
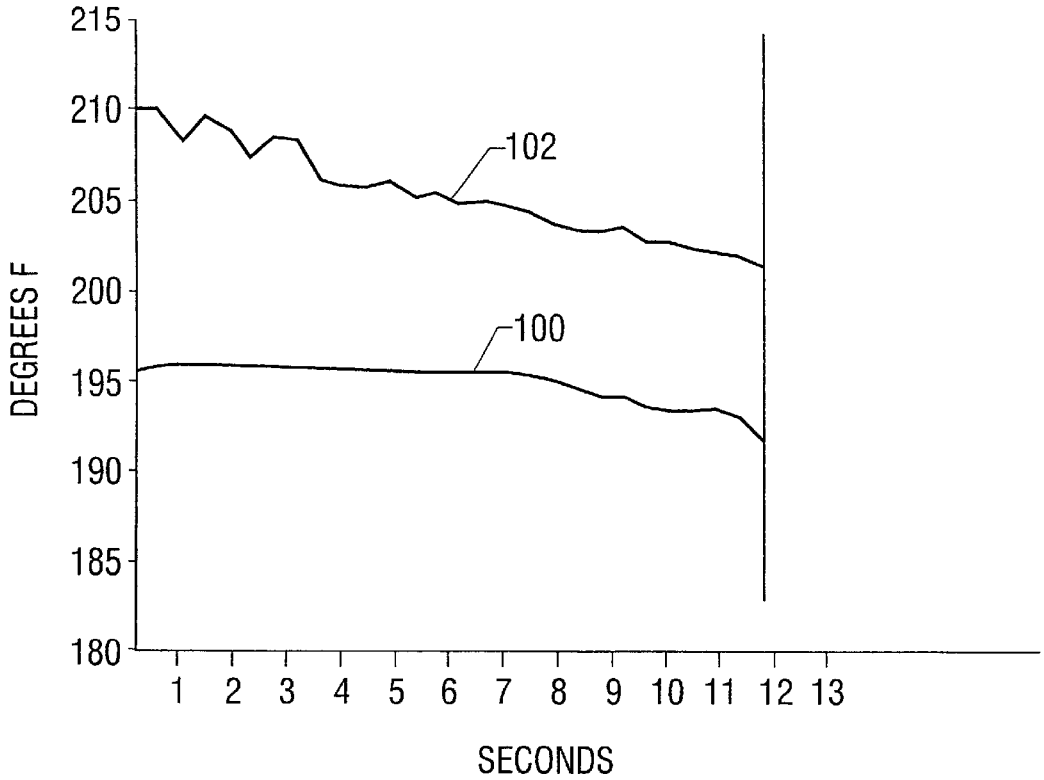
FIG. 4 is a graph of the temperature increase of the dispensed water as compared to the temperature of the water in the tank when a secondary heating element adjusted to provide 750 watts of heat output is used.
Figure 5:
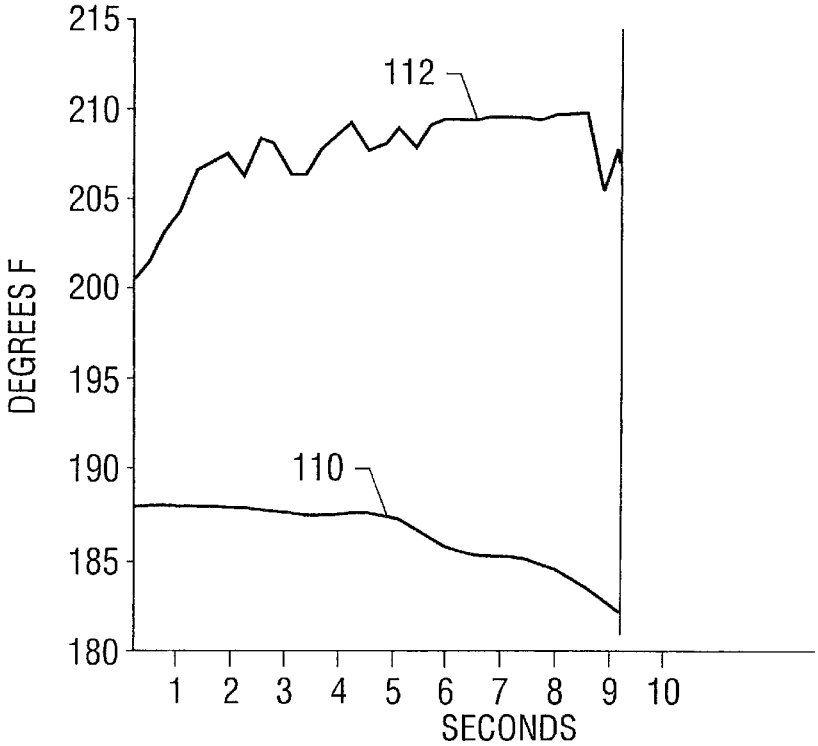
FIG. 5 is a graph of the temperature increase of the dispensed water as compared to the temperature of the water in the tank when a secondary heating element adjusted to provide 1000 watts of heat output is used.
Figure 6:
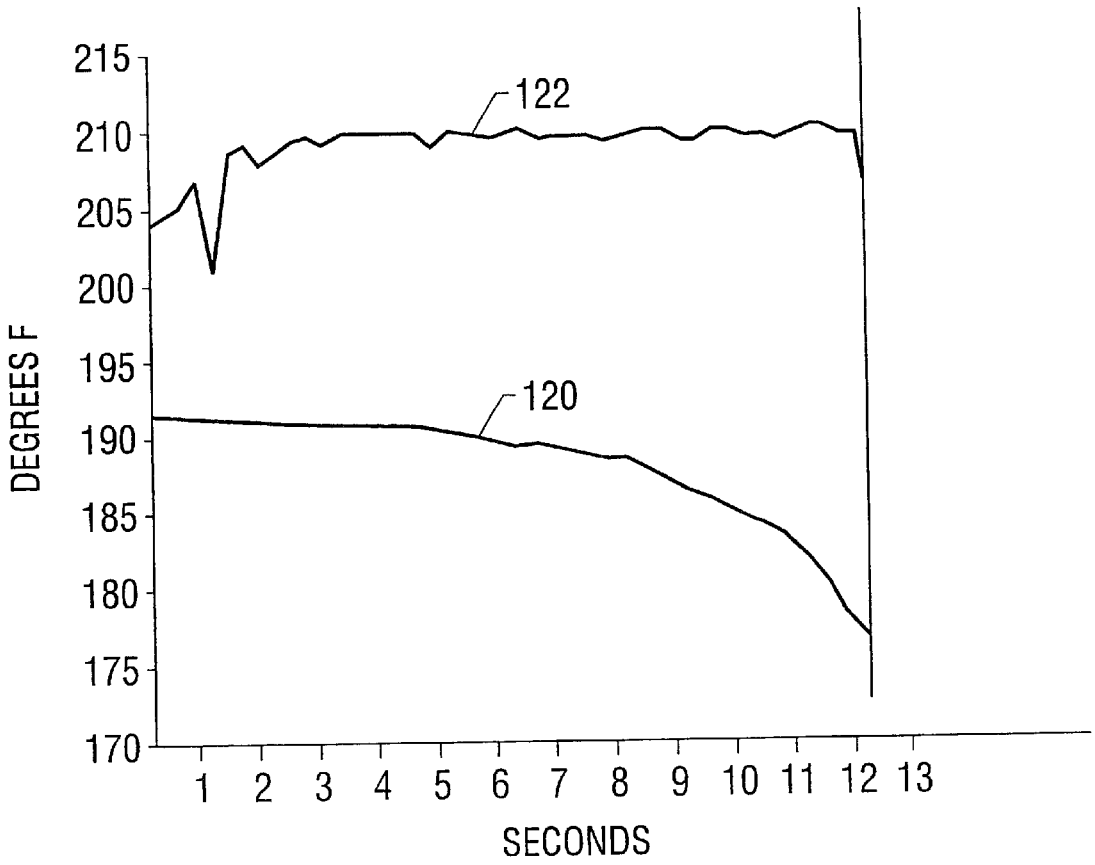
FIG. 6 is a graph of the temperature increase of the dispensed water as compared to the temperature of the water in the tank when a secondary heating element adjusted to provide 1300 watts of heat output is used.

To demonstrate the correct size or power output for the secondary heating element 50, a single secondary heating element 50, Chromalox™ SGB-1153L, rated at 1300 watts was tested. The results of such testing are shown in FIGS. 4–6. In FIG. 4, the test was performed with the secondary heating element adjusted for a 750 watt output by varying the applied voltage appropriately. In FIG. 5, the test was performed with the secondary heating element adjusted for a 1000 watt output. In FIG. 6, the test was performed with the secondary heating element adjusted for a 1300 watt output, i.e., with full voltage provided to the secondary heating element 50. In each test, the water flow rate from the hot water dispenser was approximately 0.5 gallons per minute. Referring to FIG. 4, at the beginning of the test, water 16 in the tank 12 (designated as 100) was about 195° F. Initially, the tank water temperature remains steady at about 196°F. for the first half of the test then begins to fall to about 191° F. As the test begins the water output temperature (designated as 102) is 210° F. The output water temperature is initially somewhat high due to preheating of tube 28 by secondary heating element 50 before water begins to flow through tube 28. Once water 16 begins to flow through tube 28, tube 28 is cooled by the flowing water at a rate faster than secondary heating element 50 can replace the lost heat. As a result the water output temperature 102 begins to decrease and continues to decrease until water flow through tube 28 is terminated at the end of the test. This test indicates that for this embodiment, a 750 watt secondary heater is not strong enough to provide near boiling point water for a time sufficient for most user applications, such as steeping a mug of tea, although it might be acceptable for other applications.

FIG. 5 shows the test results when the secondary heating element is set at 1000 watts. At the beginning of the test, water 16 in tank 12 (designated as 110) is about 187° F. As the test begins the water output temperature (designated as 112) quickly increases to over 205° F. and remains there. Even as the temperature of the water in the tank 110 decreases, the secondary heating element 50 is able to maintain water output temperature above 205° F., but is not able to increase past about 210° F. FIG. 5 thus indicates proper balance between rapidly providing near boiling point water while not generating steam at the indicated water flow rate. (Steam could be generated if the water flow rate was reduced).

FIG. 6 shows the test results when the secondary heating element is set at 1300 watts. At the beginning of the test, water 16 in the tank 12 (designated as 120) is about 192° F. As the test begins, the water output temperature (designated as 122) rises quickly to over 205° F. However, even when the preheated water temperature in the tank 120 decreases there is no corresponding decrease in the water output temperature 122. In fact the water output temperature rises even though the water temperature in the tank decreases, meaning that the secondary heater has enough heating capacity to add additional energy to the water in order to reach near boiling temperatures even when the water input temperature is declining. This may suggest that 1300 watts in this embodiment is too powerful for some applications, and that steam generation may result (although this may be desirable for other applications requiring steam, such as making cappuccino).

The tests depicted in FIGS. 4–6 illustrate that some amount of experimentation might be necessary on a given application to achieve the proper power level for the secondary heating element 50. As one skilled in the art will realize, the power level is a function of several characteristics, each of which must be considered, including the water flow rate, efficiency of heat transfer to the water, etc.

While the embodiment of the present invention is described as being mounted about a sink there are many possible variations of using the present invention. It could be used in vending machines that dispense hot soup, tea, or coffee. It could also be used in coffee makers. The present invention could be used anywhere that hot or near boiling water is required. While the present invention has been described with particular embodiments, one should not understand these embodiments to limit the scope of the various aspects of the invention, which instead is defined by the below claim language and its equivalents.

What is claimed is:

1. A hot water dispenser capable of dispensing water of a second temperature from a faucet, comprising:

a water tank capable of holding water and having a first heating element for heating the water to a first temperature;

a tube coupled to the water in the water tank for transmitting the water from the water tank to the faucet; and a secondary heating element coupled to the tube for heating the water from the first temperature to the second temperature.

2. The hot water dispenser of claim 1, wherein the secondary heating element is electric.

3. The hot water dispenser of claim 1, wherein the secondary heating element is gas.

4. The hot water dispenser of claim 1, further comprising a switch to activate the secondary heating element.

5. The hot water dispenser of claim 4, wherein the switch is temperature sensitive.

6. The hot water dispenser of claim 4, wherein the switch is a circuit breaker.

7. The hot water dispenser of claim 1, wherein the tube is coupled to the secondary heating element by wrapping the secondary heating element about the tube.

8. The hot water dispenser of claim 1, wherein the tube is coupled to the secondary heating element by attaching the heating element to the exterior of the tube.

9. A hot water dispenser for dispensing water of a second temperature from a faucet, comprising:

a water tank capable of holding water and having a first heating element for heating the water to a first temperature;

a tube coupled to the water in the water tank for transmitting the water from the water tank to the faucet; and a means coupled to the tube for heating the water from the first temperature to the second temperature.

10. The hot water dispenser of claim 9, wherein the means for heating the water is electric.

11. The hot water dispenser of claim 9, wherein the means for heating the water is gas.

12. The hot water dispenser of claim 9, further comprising a switch to activate the means for heating the water.

13. The hot water dispenser of claim 12, wherein the switch is temperature sensitive.

14. The hot water dispenser of claim 12, wherein the switch is a circuit breaker.

15. The hot water dispenser of claim 9, wherein the tube is coupled to the means for heating the water by wrapping the means for heating the water about the tube.

16. The hot water dispenser of claim 9, wherein the tube is coupled to the means for heating the water by attaching the means for heating the water to the exterior of the tube.

17. A method for dispensing water of a second temperature from a faucet, comprising:

heating water in a water tank to a first temperature;

transmitting the water through a tube from the water in the water tank to the faucet; and heating the transmitted water within the tube to a second temperature.

18. The method of claim 17, wherein the water is heated to the second temperature electrically.

19. The method of claim 17, wherein the water is heated to the second temperature by gas.

20. The method of claim 17, wherein the water is heated to the second temperature by activating a switch to activate the secondary heating element.

21. The method of claim 20, wherein the switch is thermostatically sensitive.

22. The method of claim 20, wherein the switch is a circuit breaker.

23. The method of claim 17, wherein heating the water within the tube to a second temperature is accomplished by coupling the tube to a secondary heating element by wrapping the secondary heating element about the tube.

24. The method of claim 17, wherein heating the water within the tube to a second temperature is accomplished by coupling the tube to a secondary heating element by attaching the heating element to the exterior of the tube.

25. The method of claim 17, further comprising activating a valve to transmit the water through the tube.

* * * * *

UNITED STATES PATENT AND TRADEMARK OFFICE

CERTIFICATE OF CORRECTION

PATENT NO. : 6,659,048 B1 
DATED : December 9, 2003
INVENTOR(S) : Paul M. DeSantis and Terrence W. Snyder It is certified that error appears in the above-identified patent and that said Letters Patent is hereby corrected as shown below:

Title page,
Item [57], ABSTRACT,
Line 5, delete "in"

Signed and Sealed this

Twenty-fourth Day of February, 2004

JON W. DUDAS
*Acting Director of the United States Patent and Trademark Office*